US009711102B2

(12) United States Patent
Kim et al.

(10) Patent No.: US 9,711,102 B2
(45) Date of Patent: Jul. 18, 2017

(54) DC-DC CONVERTER, DISPLAY APPARATUS HAVING THE SAME AND METHOD OF DRIVING DISPLAY PANEL USING THE SAME

(71) Applicant: Samsung Display Co., LTD., Yongin, Gyeonggi-Do (KR)

(72) Inventors: Yun-Tae Kim, Seoul (KR); Du-Hyun Kim, Daejeon (KR); Eun-Suk Kim, Asan-si (KR); Hoe-Mi Kim, Seoul (KR); Jin-Gwan Jang, Asan-si (KR); Bong-Chool Jeon, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 308 days.

(21) Appl. No.: 14/293,951

(22) Filed: Jun. 2, 2014

(65) Prior Publication Data

US 2015/0116307 A1 Apr. 30, 2015

(30) Foreign Application Priority Data

Oct. 25, 2013 (KR) ..... 10-2013-0128077

(51) Int. Cl.
*G09G 3/36* (2006.01)

(52) U.S. Cl.
CPC ..... *G09G 3/3688* (2013.01); *G09G 3/3603* (2013.01); *G09G 3/3648* (2013.01); *G09G 3/3696* (2013.01); *G09G 3/3677* (2013.01); *G09G 2310/0286* (2013.01); *G09G 2310/08* (2013.01); *G09G 2320/041* (2013.01)

(58) Field of Classification Search
CPC .. G09G 3/3688; G09G 3/3603; G09G 3/3648; G09G 3/3696
See application file for complete search history.

(56) References Cited

U.S. PATENT DOCUMENTS 6,919,883 B2 7/2005 Lee
2007/0085806 A1 4/2007 Moon
(Continued)

FOREIGN PATENT DOCUMENTS

KR 1020050060226 A 6/2005
KR 1020070075828 A 7/2007
(Continued)

*Primary Examiner* — Michael Faragalla
*Assistant Examiner* — Chayce Bibbee
(74) *Attorney, Agent, or Firm* — Innovation Counsel LLP

(57) ABSTRACT

A method of differently producing driving clock signals for a shift register of a gate lines driving circuit of a Liquid Crystal Display (LCD), the method includes the steps of determining whether an ambient temperature is greater than or not in comparison to a predetermined threshold temperature; in response to the determining indicating that the ambient temperature is greater, using a first ON voltage and a first charge canceling method; and in response to the determining indicating that the ambient temperature is not greater, using a second ON voltage and a second charge canceling method, where the second ON voltage is different from the first ON voltage and where the second charge canceling method is different from the first charge canceling method. The second charge canceling method may have a shorter duration than that of the first charge canceling method. The second ON voltage may be greater than the first ON voltage.

14 Claims, 7 Drawing Sheets

(56) References Cited

U.S. PATENT DOCUMENTS

| | | | | |
|---|---|---|---|---|
| 2007/0296682 | A1* | 12/2007 | Hwang | G09G 3/3677 345/100 |
| 2008/0054987 | A1* | 3/2008 | Choi | G09G 3/3696 327/512 |
| 2009/0102779 | A1 | 4/2009 | Jo | |
| 2010/0039364 | A1* | 2/2010 | Lee | G09G 3/3696 345/100 |
| 2011/0298780 | A1* | 12/2011 | Murakami | G05F 3/20 345/212 |
| 2012/0169744 | A1 | 7/2012 | Seo et al. | |

FOREIGN PATENT DOCUMENTS

| | | | |
|---|---|---|---|
| KR | 1020070109165 | A | 11/2007 |
| KR | 1020080067493 | A | 7/2008 |
| KR | 1020100060202 | A | 6/2010 |
| KR | 1020110096424 | A | 8/2011 |

* cited by examiner

DC-DC CONVERTER, DISPLAY APPARATUS HAVING THE SAME AND METHOD OF DRIVING DISPLAY PANEL USING THE SAME

PRIORITY STATEMENT

This application claims priority under 35 U.S.C. §119 to Korean Patent Application No. 10-2013-0128077, filed on Oct. 25, 2013 in the Korean Intellectual Property Office KIPO, the contents of which application are herein incorporated by reference in their entireties.

BACKGROUND

1. Field

The present disclosure of invention relates to a DC-to-DC power converter such as usable in a Liquid Crystal Display (LCD) apparatus that uses a DC-DC converter and to a method of driving a display panel using the DC-to-DC converter. More particularly, the present disclosure relates to a DC-DC converter configured for improving display quality across operating temperatures including that at a low temperature as well as at a higher temperature, and to a display apparatus having the DC-DC converter and to a method of driving a display panel using the DC-DC converter.

2. Description of Related Technology

Generally, a liquid crystal display ("LCD") apparatus includes a first substrate including a pixel electrode, a second substrate including a common electrode and a liquid crystal layer disposed between the first and second substrate. An electric field is generated by voltages applied to the pixel electrode and the common electrode. By adjusting an intensity of the electric field, a transmittance of a light passing through the liquid crystal layer may be adjusted so that a desired image may be displayed.

Generally, a display apparatus includes a display panel and a panel driver. The display panel includes a plurality of gate lines and a plurality of data lines disposed on a respective first substrate. The panel driver includes a gate lines driver providing gate signals to corresponding ones of the gate lines, a data lines driver providing data voltages to corresponding ones of the data lines. The panel driver further includes a timing controller configured for controlling respective driving timings of the gate lines driver and the data lines driver and it further includes a DC-DC converter configured for converting an input power level into appropriate output levels of respective driving voltages used for driving the panel driver.

When the display apparatus is operated at a relatively low temperature, characteristics of switching elements within the gate lines driver tend to be deteriorated relative to those of higher temperatures so that charging rates for achieving desired pixel voltages are decreased and as a result the desired pixel voltages may not be timely reached. Thus, a display quality of the display panel may be deteriorated when operating at the relatively low temperature.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding invention dates of subject matter disclosed herein.

SUMMARY

Exemplary embodiments in accordance with the present inventive concepts provide a DC-DC converter that produces temperature-adjusted clock signals differently at low ambient temperatures below a predetermined threshold than at higher temperatures to thereby improve a display quality of a display panel.

Exemplary embodiments of the present inventive concept also provide a display apparatus having the DC-DC converter where the display apparatus includes a gate lines driver circuit having shift register stages driven by the temperature-adjusted clock signals.

Exemplary embodiments of the present inventive concept also provide a method of driving a display panel using the DC-DC converter.

In an exemplary embodiment of a DC-DC converter according to the present disclosure of inventive concepts, the DC-DC converter includes a temperature compensating part and a clock generating part. The temperature compensating part generates a first ON voltage at an ambient temperature equal to or greater than a predetermined threshold temperature and a second ON voltage at a temperature less than the threshold temperature based on a generated select signal. The clock generating part generates a first clock signal and a first clock bar signal based on the first ON voltage using a first charge sharing resistor at the temperature equal to or greater than the threshold temperature. The clock generating part generates a different second clock signal and a second clock bar signal based on the second ON voltage using a second charge sharing resistor at the temperature less than the threshold temperature. The first clock bar signal having different timing from the first clock signal. The second clock bar signal having different timing from the second clock signal.

In an exemplary embodiment, the second ON voltage may be greater than the first ON voltage.

In an exemplary embodiment, a resistance of the second charge sharing resistor may be greater than a resistance of the first charge sharing resistor.

In an exemplary embodiment, the select signal may be determined by a combined resistance of a variable resistor varied according to an ambient temperature, a first resistor which is connected to the variable resistor in series and a second resistor which is connected to the variable resistor in parallel.

In an exemplary embodiment, the variable resistor may be a negative temperature coefficient ("NTC") thermistor. A resistance of the NTC thermistor may decrease when the ambient temperature increases.

In an exemplary embodiment, the temperature compensating part may include a first selecting part configured to selectively output the first ON voltage and the second ON voltage according to the select signal. The first selecting part may include a first input terminal to which the first ON voltage is applied, a second input terminal to which the second ON voltage is applied, a selecting terminal to which the select signal is applied and an output terminal configured to output one of the first ON voltage and the second ON voltage.

In an exemplary embodiment, the clock generating part may include a first generating circuit configured to generate the first clock signal and the second clock signal, a clock terminal connected to the first generating circuit, a second generating circuit configured to the first clock bar signal and the second clock bar signal, a clock bar terminal connected to a first end of the second generating circuit and a second selecting part configured to connect the first charge sharing resistor and the second charge sharing resistor to a second end of the second generating circuit according to the select signal.

In an exemplary embodiment, the first generating circuit and the second generating circuit may be disposed inside a DC-DC driving chip. The second selecting part may be disposed outside of the DC-DC driving chip.

In an exemplary embodiment, the first generating circuit, the second generating circuit and the second selecting part may be disposed in a DC-DC driving chip.

In an exemplary embodiment, the first clock signal may have a level substantially the same as a level of the first clock bar signal at an end portion of a charge sharing duration at the temperature equal to or greater than the threshold temperature.

In an exemplary embodiment, the second clock signal may have a level different from a level of the second clock bar signal at an end portion of a charge sharing duration at the temperature less than the threshold temperature.

In an exemplary embodiment of a display apparatus according to the present inventive concept, the display apparatus includes a display panel, a DC-DC converter, a gate driver and a data driver. The display panel displays an image. The DC-DC converter includes a temperature compensating part and a clock generating part. The temperature compensating part generates a first ON voltage at a temperature equal to or greater than a threshold temperature and a second ON voltage at a temperature less than the threshold temperature based on a gate clock signal according to a select signal. The clock generating part generates a first clock signal and a first clock bar signal based on the first ON voltage using a first charge sharing resistor at the temperature equal to or greater than the threshold temperature. The clock generating part generates a second clock signal and a second clock bar signal based on the second ON voltage using a second charge sharing resistor at the temperature less than the threshold temperature. The gate driver generates a gate signal based on the first clock signal, the first clock bar signal, the second clock signal and the second clock bar signal and provides the gate signal to the display panel. The data driver generates a data voltage and to provide the data voltage to the display panel. The first clock bar signal having different timing from the first clock signal. The second clock bar signal having different timing from the second clock signal.

In an exemplary embodiment, the second ON voltage may be greater than the first ON voltage.

In an exemplary embodiment, a resistance of the second charge sharing resistor may be greater than a resistance of the first charge sharing resistor.

In an exemplary embodiment, the select signal may be determined by a combined resistance of a variable resistor varied according to an ambient temperature, a first resistor which is connected to the variable resistor in series and a second resistor which is connected to the variable resistor in parallel.

In an exemplary embodiment, the temperature compensating part may include a first selecting part configured to selectively output the first ON voltage and the second ON voltage according to the select signal. The first selecting part may include a first input terminal to which the first ON voltage is applied, a second input terminal to which the second ON voltage is applied, a selecting terminal to which the select signal is applied and an output terminal configured to output one of the first ON voltage and the second ON voltage.

In an exemplary embodiment, the clock generating part may include a first generating circuit configured to generate the first clock signal and the second clock signal, a clock terminal connected to the first generating circuit, a second generating circuit configured to the first clock bar signal and the second clock bar signal, a clock bar terminal connected to a first end of the second generating circuit and a second selecting part configured to connect the first charge sharing resistor and the second charge sharing resistor to a second end of the second generating circuit according to the select signal.

In an exemplary embodiment of a method of driving a display panel according to the present inventive concept, the method includes generating a first ON voltage at a temperature equal to or greater than a threshold temperature and a second ON voltage at a temperature less than the threshold temperature based on a gate clock signal according to a select signal, generating a first clock signal and a first clock bar signal based on the first ON voltage using a first charge sharing resistor at the temperature equal to or greater than the threshold temperature and generating a second clock signal and a second clock bar signal based on the second ON voltage using a second charge sharing resistor at the temperature less than the threshold temperature, generating a gate signal based on the first clock signal, the first clock bar signal, the second clock signal and the second clock bar signal, generating a data voltage and displaying an image based on the gate signal and the data voltage. The first clock bar signal having different timing from the first clock signal. The second clock bar signal having different timing from the second clock signal.

In an exemplary embodiment, the second ON voltage may be greater than the first ON voltage.

In an exemplary embodiment, a resistance of the second charge sharing resistor may be greater than a resistance of the first charge sharing resistor.

According to the DC-DC converter, the display apparatus having the DC-DC converter and the method of driving the display panel using the DC-DC converter, the DC-DC converter generates a first clock signal using a first charge sharing resistor at a temperature equal to or greater than a threshold temperature and a second clock signal using a second charge sharing resistor at a temperature less that the threshold temperature. Thus, the decrease of the charging rate of the pixel voltage due to deterioration of the characteristics of the switching element of the gate driver may be compensated. Thus, the display quality of the display panel may be improved.

BRIEF DESCRIPTION OF THE DRAWINGS

The above and other features and advantages of the present disclosure of inventive concepts will become more apparent by describing in detailed exemplary embodiments in accordance with the same and with reference to the accompanying drawings, in which.

DETAILED DESCRIPTION

Hereinafter, the present disclosure of inventive concepts will be explained in detail with reference to the accompanying drawings.

Figure 1:
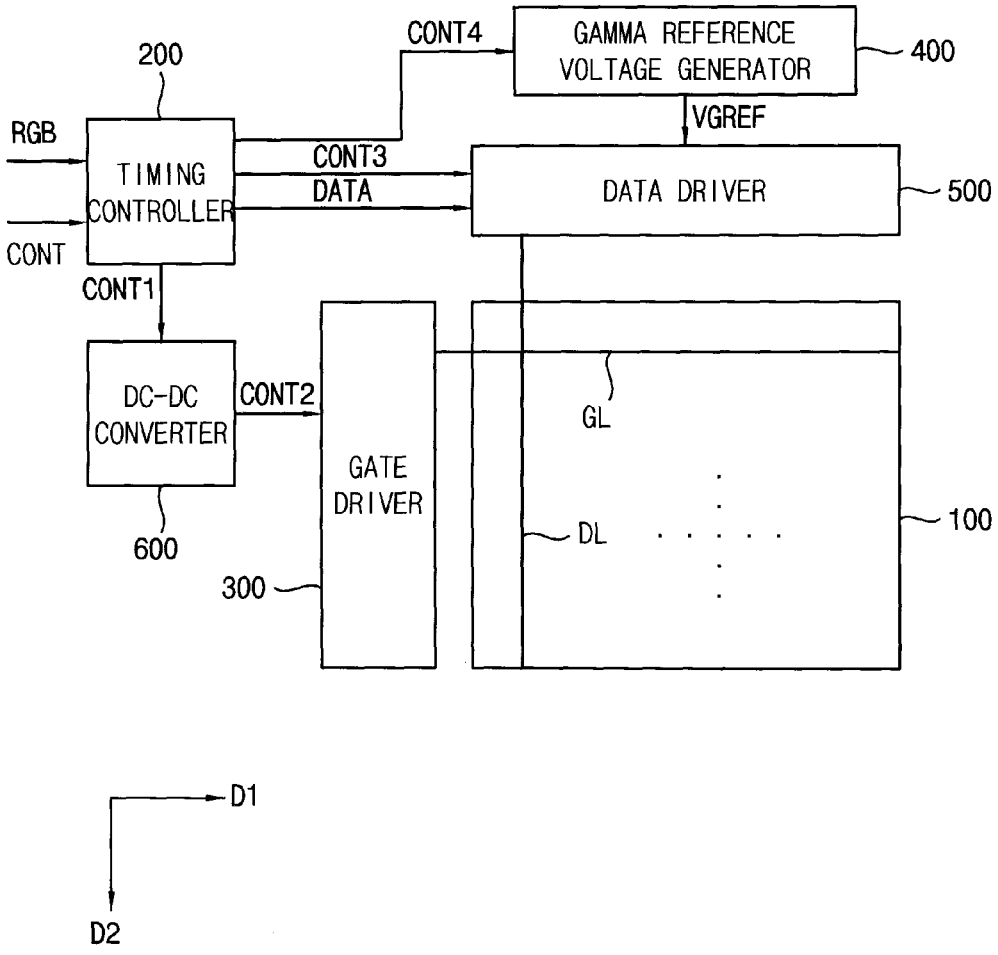
FIG. 1 is a block diagram illustrating a display apparatus according to an exemplary embodiment of the present disclosure of inventive concepts.

FIG. 1 is a block diagram illustrating a display apparatus according to an exemplary embodiment in accordance with the present disclosure of inventive concepts.

Referring to FIG. 1, the display apparatus includes a display panel 100 (e.g., a Liquid Crystal Display (LCD) panel) and a panel driver. The panel driver includes a timing controller 200, a gate lines driver 300, a gamma reference voltage generator 400, a data lines driver 500 and a DC-DC converter 600.

The display panel 100 has a display region on which an electronically defined image is displayed and a peripheral region adjacent to but outside the display region.

The display panel 100 includes a plurality of gate lines GL, a plurality of data lines DL and a plurality of unit pixels connected to the gate lines GL and the data lines DL. The gate lines GL extend in a first direction D1 and the data lines DL extend in a second direction D2 crossing the first direction D1.

Each unit pixel includes a switching element (not shown—for example a thin film transistor), a liquid crystal capacitor (not shown) and a storage capacitor (not shown). The liquid crystal capacitor and the storage capacitor are electrically connected to the switching element. The unit pixels may be disposed in a matrix form in accordance with the crossing gate lines and data lines.

The timing controller 200 receives input image data signal RGB and an input control signal CONT from an external apparatus (not shown). The input image data signal may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a third control signal CONT3, a fourth control signal CONT4 and a data signal DATA based on the input image data signal RGB and the input control signal CONT.

The timing controller 200 generates the first control signal CONT1 for controlling an operation of the gate lines driver 300 based on the input control signal CONT, and outputs the first control signal CONT1 to the DC-DC converter 600. The first control signal CONT1 may further include a vertical start signal and a gate clock signal.

The timing controller 200 generates the third control signal CONT3 for controlling an operation of the data lines driver 500 based on the input control signal CONT, and outputs the third control signal CONT3 to the data lines driver 500. The third control signal CONT3 may include a horizontal start signal and a load signal.

The timing controller 200 generates the data signal DATA based on the input image data signal RGB. The timing controller 200 outputs the data signal DATA to the data lines driver 500.

The timing controller 200 generates the fourth control signal CONT4 for controlling an operation of the gamma reference voltage generator 400 based on the input control signal CONT, and outputs the fourth control signal CONT4 to the gamma reference voltage generator 400.

The gate lines driver 300 generates gate signals for driving the gate lines GL in response to a second control signal CONT2 received from the DC-DC converter 600. The gate lines driver 300 sequentially outputs respective gate signals to respective ones of the gate lines GL.

The gate lines driver 300 may be directly mounted on the display panel 100, or may be connected to the display panel 100 as a tape carrier package (TCP) type. Alternatively, the gate lines driver 300 may be monolithically integrated as part of the display panel 100.

The gamma reference voltage generator 400 generates a gamma reference voltage VGREF in response to the fourth control signal CONT4 received from the timing controller 200. The gamma reference voltage generator 400 provides the gamma reference voltage VGREF to the data lines driver 500. The gamma reference voltage VGREF has a value corresponding to a level of the data signal DATA.

In an exemplary embodiment, the gamma reference voltage generator 400 may be disposed in the timing controller 200, or in the data lines driver 500.

The data lines driver 500 receives the third control signal CONT3 and the data signal DATA from the timing controller 200, and receives the gamma reference voltages VGREF from the gamma reference voltage generator 400. The data driver 500 converts the data signal DATA into corresponding data voltages of the analog type using the gamma reference voltages VGREF. The data lines driver 500 sequentially outputs the respective analog data voltages to corresponding ones of the data lines DL.

The data lines driver 500 may be directly mounted on the display panel 100, or may be connected to the display panel 100 in a TCP type. Alternatively, the data lines driver 500 may be monolithically integrated as part of the display panel 100.

The DC-DC converter 600 receives the first control signal CONT1 from the timing controller 200. The DC-DC converter 600 generates the second control signal CONT2 based on the first control signal CONT1. The DC-DC converter 600 adjusts a level of the first control signal CONT1 to generate the second control signal CONT2. The DC-DC converter outputs the second control signal CONT2 to the gate lines driver 300.

A structure and an operation of the DC-DC converter 600 are explained referring to FIGS. 2 to 8B in detail.

Figure 2:
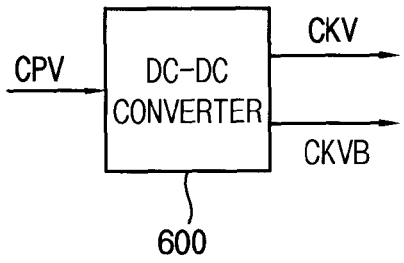
FIG. 2 is a block diagram illustrating a DC-DC converter of FIG. 1.

FIG. 2 is a block diagram illustrating an overview of the DC-DC converter 600 of FIG. 1.

Referring to FIGS. 1 and 2, the DC-DC converter 600 receives a gate clock signal CPV from the timing controller 200. The DC-DC converter 600 responsively generates a clock signal CKV and a corresponding clock bar signal CKVB based on the gate clock signal CPV received from the timing controller 200. The DC-DC converter 600 outputs voltage levels representing the clock signal CKV and the clock bar signal CKVB to the gate lines driver 300.

Although not shown in figures, the DC-DC converter 600 receives a first vertical start signal from the timing controller 200 and adjusts a level of the first vertical start signal to generates a second vertical start signal. The DC-DC converter 600 may output the second vertical start signal to the gate lines driver 300.

In the present exemplary embodiment, the outputting of the converted level signals (e.g. the clock signal CKV and the clock bar signal CKVB) generated by the DC-DC converter 600 to the gate lines driver 300 is mainly explained. However, the present disclosure of inventive concepts is not limited thereto. Other converted level signals which are generated by the DC-DC converter 600 may be outputted to the data lines driver 500 and the gamma reference voltage generator 400. These other converted level signals may be functions of temperature compensation just as are the converted level gate driver signals (e.g. the clock signal CKV and the clock bar signal CKVB) detailed here.

Hereinafter, the generating of the clock signal CKV and the clock bar signal CKVB by the DC-DC converter 600 based on the gate clock signal CPV is mainly explained.

Figure 3:
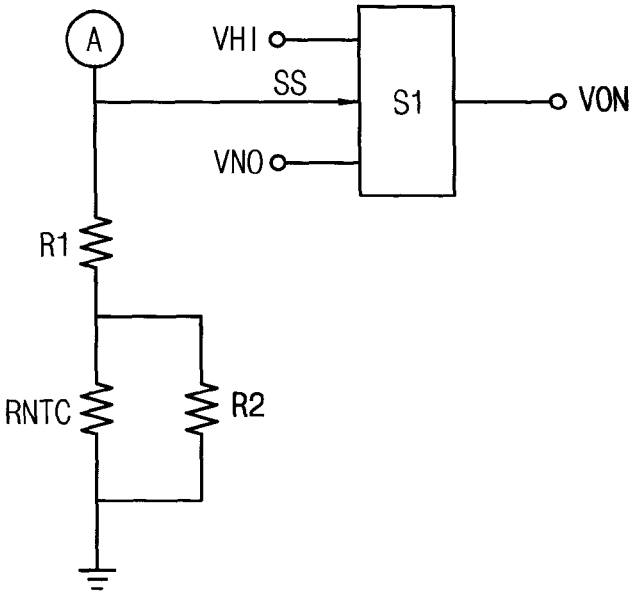
FIG. 3 is an equivalent circuit diagram illustrating a temperature compensating part of the DC-DC converter of FIG. 2.
Figure 4:
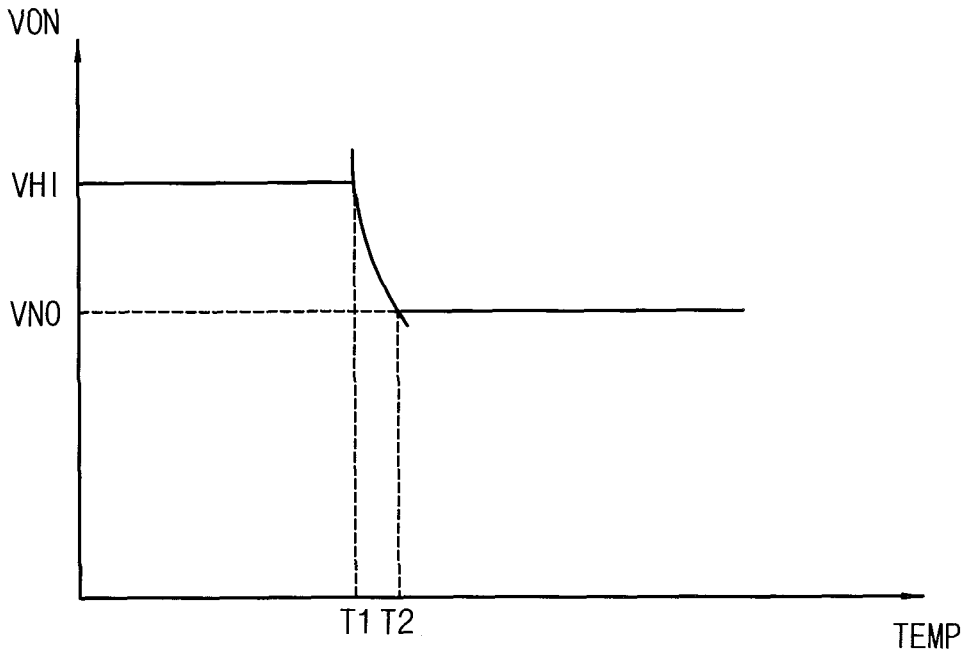
FIG. 4 is a temperature versus voltage graph illustrating an operation of the temperature compensating part of the DC-DC converter of FIG. 3.
Figure 5:
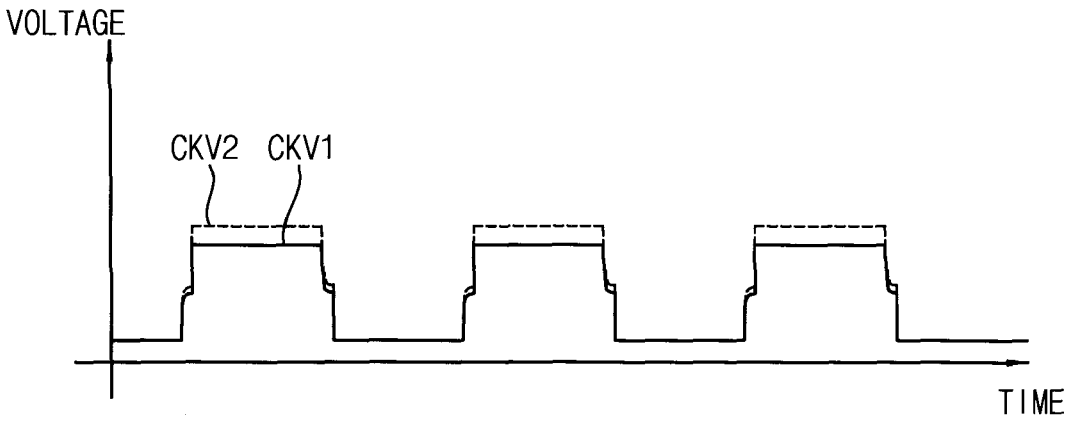
FIG. 5 is a voltage versus time waveform diagram illustrating a first clock signal and a second clock signal according to the operation of the temperature compensating part of the DC-DC converter of FIG. 3.

FIG. 3 is an equivalent circuit diagram illustrating a temperature compensating part of the DC-DC converter 600 of FIG. 2. FIG. 4 is a graph illustrating an operation of the temperature compensating part of the DC-DC converter 600 of FIG. 3. FIG. 5 is a waveform diagram illustrating a first clock signal and a second clock signal according to the operation of the temperature compensating part of the DC-DC converter 600 of FIG. 3.

Referring to FIGS. 2 to 5, the DC-DC converter 600 includes the temperature compensating part generating an ON voltage VON where the latter is used to generate the clock signal CKV and the clock bar signal CKVB.

When an ambient temperature (as determined by an ambient temperature determining device—not shown) is less than a predetermined threshold temperature (Tamb<Tthresh), the temperature compensating part outputs the VON signal as a generated second ON voltage VHI. When the ambient temperature is equal to or greater than the threshold temperature (Tamb≥Tthresh), an operating mode is determined to be a normal temperature mode and instead a "normal" first ON voltage VNO(rmal) is generated. In other words, when the ambient temperature is less than the threshold temperature, the temperature compensating part generates the boosted, second ON voltage VHI which is different from (greater than) the normal-mode, first ON voltage VNO. When the ambient temperature is less than the threshold temperature, the operating mode is deemed to be the abnormal low temperature mode.

In the given examples, the second ON voltage VHI is greater than the first ON voltage VNO.

In FIG. 3, the temperature compensating part includes a first selecting part S1. The first selecting part S1 includes a first input terminal to which the first ON voltage VNO is applied, a second input terminal to which the second ON voltage VHI is applied, a selecting terminal to which a select signal SS is applied and an output terminal selectively outputting one of the first ON voltage VNO and the second ON voltage VHI according to the select signal SS.

For example, the first selecting part S1 may include an analog signal multiplexer and/or the first selecting part S1 may include an operational amplifier.

In one embodiment, the select signal SS is determined by applying a constant current ((A)) to a combined resistance of a variable resistor RTNC varied according to the ambient temperature, a first resistor R1 which is connected to the variable resistor RTNC in series and a second resistor R2 which is connected to the variable resistor RTNC in parallel. The select signal SS may be a voltage signal that is a function of the applied constant current signal ((A)) and the temperature-dependent resistance of variable resistor RTNC.

A first end of the first resistor R1 is connected to the selecting terminal and a second end of the first resistor R1 is connected to a first end of the variable resistor RTNC. A second end of the variable resistor RTNC is connected to a ground. A first end of the second resistor R2 is connected to the first end of the variable resistor RTNC and a second end of the second resistor R2 is connected to the second end of the variable resistor RTNC.

For example, the variable resistor RTNC may be a negative temperature coefficient ("NTC") thermistor. When the ambient temperature TEMP increases, a resistance of the NTC thermistor responsively decreases.

In FIG. 3, Element A connected to the selecting terminal is a reference current source used to select one of the first ON voltage VNO and the second ON voltage VHI. For example, the reference current may be about 50 uA.

In FIG. 4, the utilized ON voltage VON is determined according to the ambient temperature TEMP. For example, when the ambient temperature TEMP is less than a predetermined first (e.g., threshold) temperature T1, the utilized ON voltage VON is the higher, second ON voltage VHI. When the ambient temperature greater than a second temperature T2 (and thus also greater than the predetermined first (e.g., threshold) temperature T1), the utilized ON voltage VON is the lower first ON voltage VNO.

An interposed variable curve for the utilized ON voltage VON corresponding to the ambient temperature TEMP between the first temperature T1 and the second temperature T2 is defined by a variable resistor RTNC.

The threshold temperature may be set as any temperature between and inclusive of the first temperature T1 and the second temperature T2. For example, the threshold temperature may be set equal to the first temperature T1. Alternatively, the threshold temperature may be set equal to the second temperature T2. Yet otherwise and as an example, the threshold temperature may be set equal to an average between the first temperature T1 and the second temperature T2.

In FIG. 5, when the ambient temperature is determined to be equal to or greater than the threshold temperature (Tamb≥Tthresh; solid plot line case), and in response, the DC-DC converter 600 generates a first clock signal CKV1 based on the first ON voltage VNO (a.k.a. Vnormal). When the ambient temperature is less than the threshold temperature (Tamb<Tthresh; dashed plot line case), the DC-DC converter 600 generates a second clock signal CKV2 based on the second ON voltage VHI (the abnormal level).

The first clock signal CKV1 may have a high level of the first ON voltage VNO and a low level of a gate off voltage (Voff, which could be common voltage Vcom). The second clock signal CKV2 may have a high level of the second ON voltage VHI and a low level of the gate off voltage. The first clock signal CKV1 and the second clock signal CKV2 may have the same timing.

Although not shown in FIG. 5, when the ambient temperature is equal to or greater than the threshold temperature, the DC-DC converter 600 may generate a first clock bar signal based on the first ON voltage VNO. The first clock bar signal has a different timing from the first clock signal CKV1 (for example, 180 degrees out of phase). When the ambient temperature is less than the threshold temperature, the DC-DC converter 600 may generate a second clock bar signal based on the second ON voltage VHI. The second clock bar signal has a different timing from the second clock signal CKV2.

The first clock bar signal may have a high level of the first ON voltage VNO and a low level of a gate off voltage. The second clock bar signal may have a high level of the second ON voltage VHI and a low level of the gate off voltage. The first clock bar signal CKV1 and the second clock bar signal CKV2 may have the same timing.

When the ambient temperature is relatively low, characteristics of the switching elements in the gate lines driver 300 may be deteriorated. Accordingly, relatively higher voltage (VHI) may be required to turn on the switching elements in the gate driver 300 at the low ambient temperature and at speeds comparable to those attained when the ambient temperature is normal and VNO (also denoted here as Vnormal) is used.

Thus, the DC-DC converter 600 may generate the second clock signal CKV2 and the second clock bar signal based on the second ON voltage VHI which is greater than the first ON voltage VNO at a temperature less than the threshold temperature. Therefore, the decrease of the charging rate of pixel units of the display panel 100 due to deterioration of the characteristics of the switching elements of the gate lines driver 300 may be compensated for and the pixel units may be charged for lengths of time substantially the same as those used when the ambient temperature is normal even though the ambient temperature is subnormal (Tamb<Tthresh).

Figure 6:
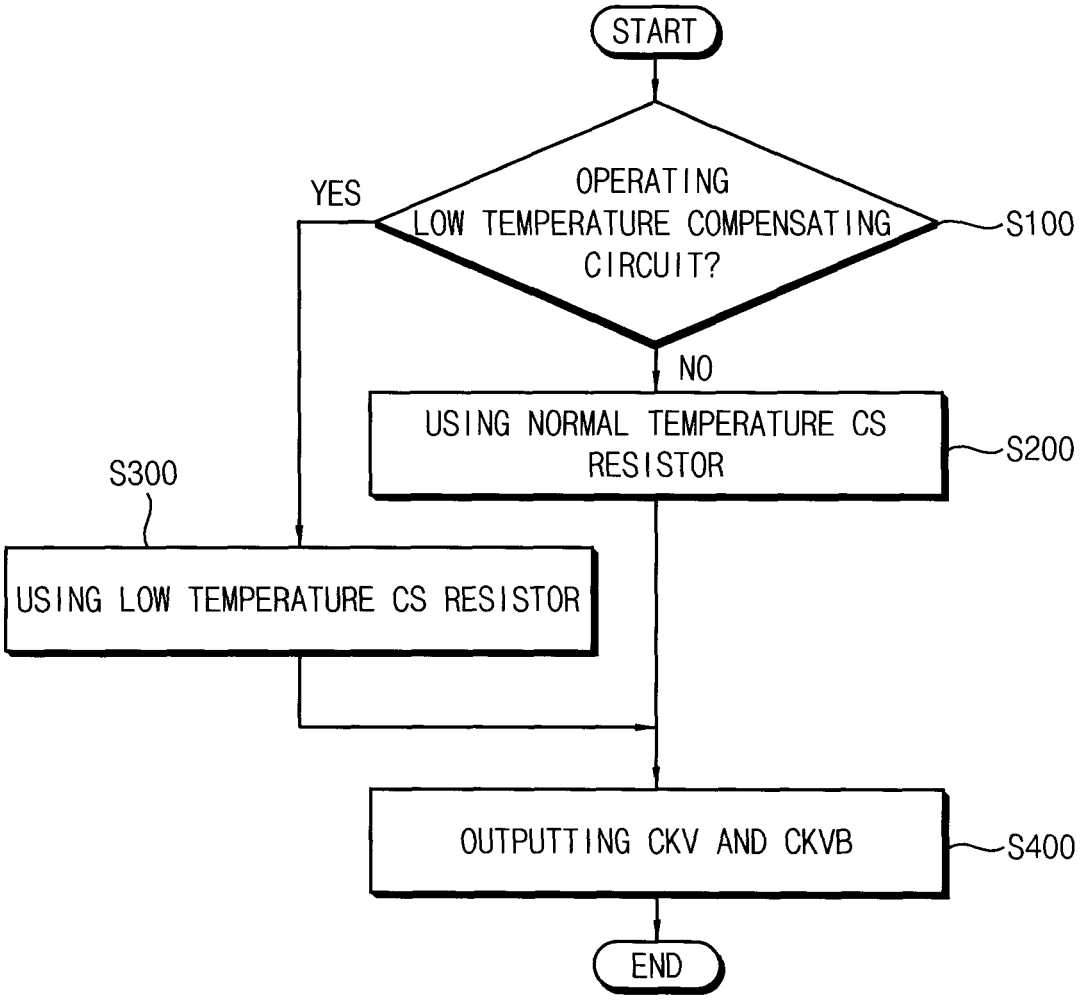
FIG. 6 is a flowchart illustrating an operation of the DC-DC converter of FIG. 2.
Figure 7:
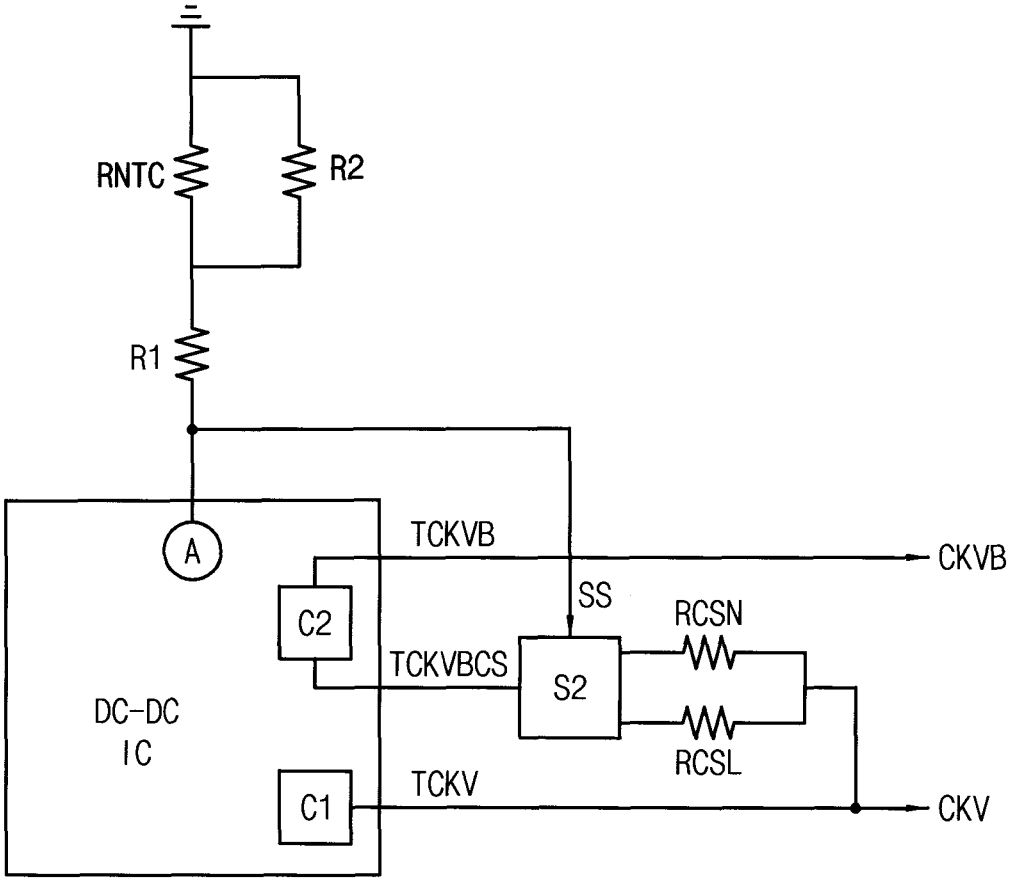
FIG. 7 is an equivalent circuit diagram illustrating a clock generating part of the DC-DC converter of FIG. 2.
Figure 8A:
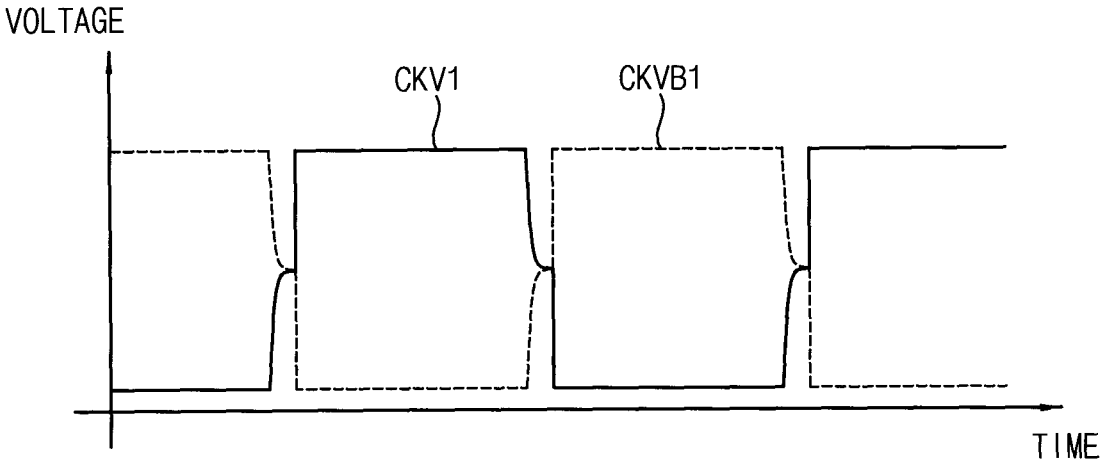
FIG. 8A is a waveform diagram illustrating a first clock signal and a first clock bar signal generated by the DC-DC converter of FIG. 2.
Figure 8B:
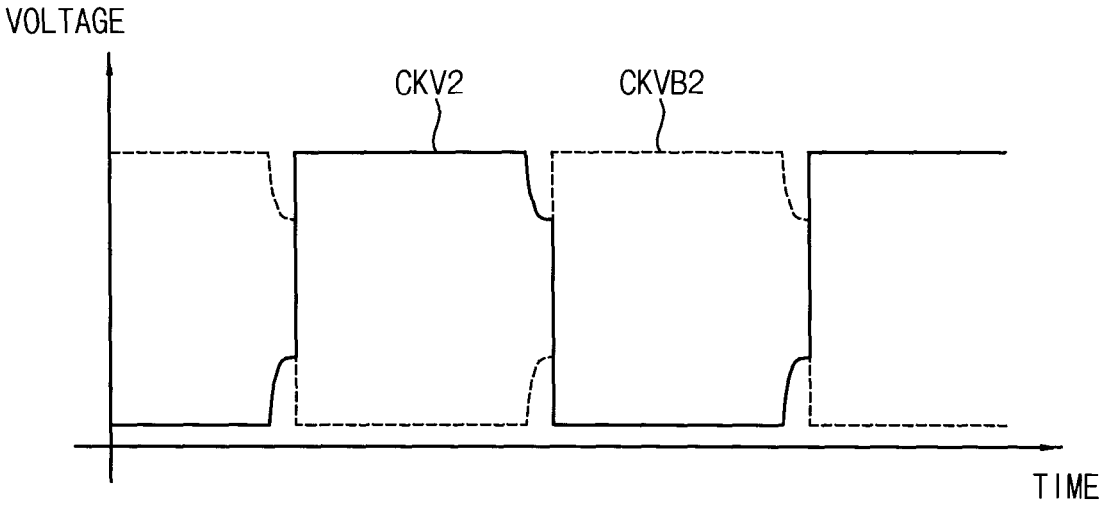
FIG. 8B is a waveform diagram illustrating a second clock signal and a second clock bar signal generated by the DC-DC converter of FIG. 2.

FIG. 6 is a flowchart illustrating an operation of the DC-DC converter 600 of FIG. 2. FIG. 7 is an equivalent circuit diagram illustrating a clock generating part of one embodiment of the DC-DC converter 600 of FIG. 2 wherein a DC-DC integrated circuit (IC) is used. FIG. 8A is a waveform diagram illustrating the first clock signal and the first clock bar signal generated by the DC-DC converter 600 of FIG. 2. FIG. 8B is a waveform diagram illustrating the second clock signal and the second clock bar signal generated by the DC-DC converter 600 of FIG. 2.

Referring to FIGS. 2 to 8B, the DC-DC converter 600 includes the clock generating part which generates the clock signal CKV and the clock bar signal CKVB.

The clock generating part generates the first clock signal CKV1 and the first clock bar signal CKVB1 having a timing different from the first clock signal CKV1 based on the first ON voltage VNO using a first charge sharing resistor RCSN at a temperature equal to or greater than the threshold temperature. The clock generating part generates the second clock signal CKV2 and the second clock bar signal CKVB2 having a timing different from the second clock signal CKV2 based on the second ON voltage VHI using a second charge sharing resistor RCSL at a temperature less than the threshold temperature. In particular, the repetition periods of CKV1 (solid line plot in FIG. 8A) and CKV2 (solid line plot in FIG. 8B) are substantially the same even though the switching rates of CKV1 (FIG. 8A) and CKV2 (FIG. 8B) are not the same. (More specifically, for the illustrated embodiment, CKV1 (FIG. 8A) drops to a mid-level (halfway between Von and Voff) much more rapidly than does CKV2 (FIG. 8B). Also and as seen in the timing diagrams, the repetition periods of CKVB1 (dashed line plot in FIG. 8A for the "bar" version of the clock) and CKVB2 (dashed line plot in FIG. 8B) are substantially the same even though the switching rates of CKVB1 (FIG. 8A) and CKVB2 (FIG. 8B) are not the same. (More specifically, for the illustrated embodiment, CKVB1 (FIG. 8A) drops to a mid-level (halfway between Von and Voff) much more rapidly than does CKVB2 (FIG. 8B). Yet more specifically, the drop of CKV1 to the mid-level (halfway between Von and Voff) is due to a charge sharing operation (whose circuit is not shown) where the CKV line is shorted to the CKVB line so that their opposed charges cancel each other out. This charge sharing operation is carried out for a longer length of time and/or at a faster rate in the case of FIG. 8A than it is in the case of FIG. 8B. Hence the waveforms are different.

More specifically and for the embodiment of FIG. 7, the DC-DC IC in the clock generating part includes a first generating circuit C1 generating the first clock signal CKV and a second generating circuit C2 generating the second clock signal CKVB. The DC-DC IC has a first clock terminal TCKV outputting the first clock signal CKV and a second clock terminal TCKVB outputting the bar clock signal CKVB. The DC-DC integrated circuit further has a third or control terminal TCKVBCS that may be used to determine if the second generating circuit C2 is generating the normal mode first clock bar signal CKVB1 or the subnormal temperature and thus higher second clock bar signal CKVB2. The second generating circuit C2 is coupled by way of the control terminal TCKVBCS to a second selecting part S2 which is further connected to a normal-mode, first charge sharing resistor RCSN and to a low-temperature mode, second charge sharing resistor RCSL, where the second selecting part S2 determines which will be operatively coupled to the second generating circuit C2 according to a supplied select signal SS.

The first generating circuit C1 generates the first and second clock signals CKV1 and CKV2 based on the first and second ON voltages VNO and VHI and the gate off voltage. Although not shown in figures, the first generating circuit C1 may generate the first and second clock signals CKV1 and CKV2 using two switching elements connected in series.

The second generating circuit C2 generates the first and second clock bar signals CKVB1 and CKVB2 based on the first and second ON voltages VNO and VHI and the gate off voltage. Although not shown in figures, the second generating circuit C2 may generate the first and second clock bar signals CKVB1 and CKVB2 using two switching elements connected in series.

The second generating circuit C2 includes a charge sharing circuit (not shown). The clock signal CKV1 and CKV2 and the clock bar signal CKVB1 and CKVB2 are charge-shared in a push-pull method using a selectively picked one of the charge sharing resistors RCSN and RCSL which are connected between the first generating circuit C1 and the second generating circuit C2 via the second selecting part S2.

In other words, in the present exemplary embodiment of FIG. 7, the first generating circuit C1 and the second generating circuit C2 are monolithically integrally disposed inside a DC-DC driving chip DC-DC IC. The second selecting part S2 is disposed outside of the DC-DC driving chip DC-DC IC.

The second selecting part S2 may be connected to the second generating circuit C2 through a clock bar charge sharing terminal TCKVBCS.

The second selecting part S2 includes an input terminal connected to the clock bar charge sharing terminal TCKVBCS, a first output terminal connected to the first charge sharing resistor RCSN, a second output terminal connected to the second charge sharing resistor RCSL and a selecting terminal to which the select signal SS is applied.

For example, the second selecting part S2 may include a multiplexer and/or the second selecting part S2 may include an operational amplifier.

The select signal SS is determined by a combined resistance of the variable resistor RTNC varied according to the ambient temperature, the first resistor R1 which is connected to the variable resistor RTNC in series and the second resistor R2 which is connected to the variable resistor RTNC in parallel. The select signal SS may be a voltage signal obtained by way of a reference current signal ((A)) as applied to a variable resistance network.

The select signal SS may be the same as the signal applied to the first selecting part S1.

Hereinafter, an operation of the DC-DC converter 600 is explained in detail referring to FIG. 6.

The temperature compensating part determines if it is operating a low temperature compensating circuit or not according to an internally detected (inside the DC-DC IC) level of the select signal SS (step S100).

When the ambient temperature is equal to or greater than the threshold temperature, the temperature compensating part does not operate the low temperature compensation and generates the normal first ON voltage VNO as the ON voltage VON. The clock generating part uses the normal temperature charge sharing resistor RCSN according to the select signal SS (step S200).

When the ambient temperature is less than the threshold temperature, the temperature compensating part operates the low temperature compensation and generates the second ON voltage VHI as the ON voltage VON. The clock generating part uses the low temperature charge sharing resistor RCSL according to the select signal SS (step S300).

The clock generating part operates in a charge sharing mode to generate the clock signal CKV and the clock bar signal CKVB using one of the normal temperature charge sharing resistor RCSN and the low temperature charge sharing resistor RCSL (step S400).

For example, the second chare sharing resistor RCSL is greater than the first charge sharing resistor RCSN. For example, the second chare sharing resistor RCSL may have a resistance value that is about ten times that of the first charge sharing resistor RCSN.

As shown in FIG. 8A, the DC-DC converter 600 generates the first clock signal CKV1 and the first clock bar signal CKVB1 based on the first ON voltage VNO using the first charge sharing resistor RCSN at a temperature equal to or greater than the threshold temperature (normal temperature mode).

For example, the first clock bar signal CKVB1 may be an inverted version signal of the first clock signal CKV1.

When the first clock signal CKV1 decreases from a high level to a low level, the first clock bar signal CKVB1 increases from the low level to the high level in a charge sharing duration.

When the first clock signal CKV1 increases from the low level to the high level, the first clock bar signal CKVB1 decreases from the high level to the low level in the charge sharing duration.

Increment of the first clock signal CKV1 is substantially equal to decrement of the first clock bar signal CKVB1 in the charge sharing duration. Decrement of the first clock signal CKV1 is substantially equal to increment of the first clock bar signal CKVB1 in the charge sharing duration.

In addition, the first clock signal CKV1 may have a level substantially the same as a level of the first clock bar signal CKVB1 at an end portion of the charge sharing duration.

As shown in FIG. 8B, the DC-DC converter 600 generates the second clock signal CKV2 and the second clock bar signal CKVB2 based on the second ON voltage VHI using the second charge sharing resistor RCSL at a temperature less than the threshold temperature (low temperature mode).

For example, the second clock bar signal CKVB2 may be an inverted version signal of the second clock signal CKV2.

The second clock signal CKV2 may have a periodicity timing substantially the same as that of the first clock signal CKV1. The second clock bar signal CKVB2 may have a timing substantially the same as a timing of the first clock bar signal CKVB1.

A high level of the second clock signal CKV2 is based on the second ON voltage VHI so that the high level of the second clock signal CKV2 may be greater than the high level of the first clock signal CKV1 which is based on the first ON voltage VNO.

When the second clock signal CKV2 decreases from a high level to a low level, the second clock bar signal CKVB2 increases from the low level to the high level in a charge sharing duration.

When the second clock signal CKV2 increases from the low level to the high level, the second clock bar signal CKVB2 decreases from the high level to the low level in the charge sharing duration.

Increment of the second clock signal CKV2 is substantially equal to decrement of the second clock bar signal CKVB2 in the charge sharing duration. Decrement of the second clock signal CKV2 is substantially equal to increment of the second clock bar signal CKVB2 in the charge sharing duration.

In the low temperature mode, the second clock signal CKV2 may have a level different from a level of the second clock bar signal CKVB2 at an end portion of the charge sharing duration.

The increment of the second clock signal CKV2 is less than the increment of the first clock signal CKV1 shown in FIG. 8A in the charge sharing duration. The decrement of the second clock signal CKV2 is less than the decrement of the first clock signal CKV1 shown in FIG. 8A in the charge sharing duration.

Thus, the second clock signal CKV2 generated in the low temperature mode may maintain the high level longer than does the first clock signal CKV1 generated in the normal temperature mode. In addition, during an end portion of a gate on duration which highly affects the pixel charging ratio, the second clock signal CKV2 may maintain the high level relatively longer.

Thus, a decrease of the charging rate of the pixel electrodes to the desired pixel voltage due to deterioration of the characteristics of the switching elements of the gate lines driver 300 at the low temperature may be compensated for.

According to the present exemplary embodiment, the DC-DC converter 600 may generate the second clock signal CKV2 and the second clock bar signal CKVB2 based on the second ON voltage VHI which is greater than the first ON voltage VNO at the temperature less than the threshold temperature. In addition, the DC-DC converter may generate the second clock signal CKV2 and the second clock bar signal CKVB2 using the second charge sharing resistor RCSL having a resistance greater than a resistance of the first charge sharing resistor RCSN. Thus, the decrease of the charging rate of a pixel of the display panel 100 due to deterioration of the characteristics of the switching element of the gate driver 300 may be compensated for. Therefore, the display quality of the display apparatus may be improved even though the ambient temperature is subnormal.

Figure 9:
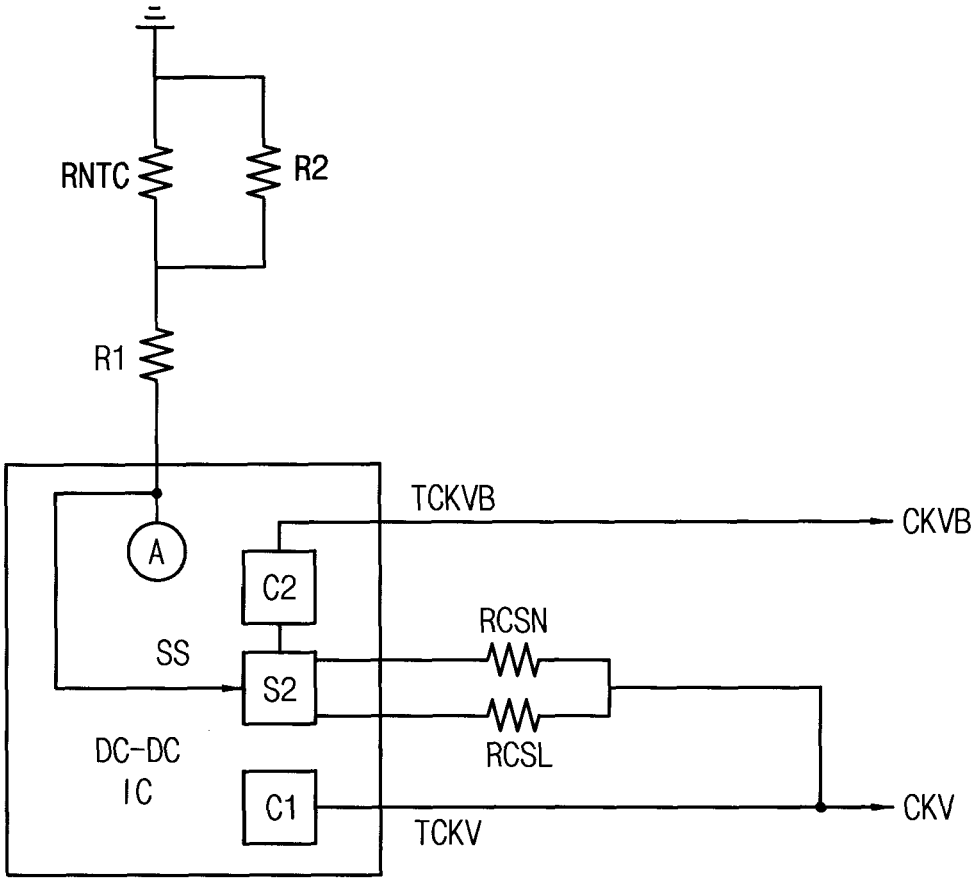
FIG. 9 is a block diagram illustrating a clock generating part of a DC-DC converter according to an exemplary embodiment of the present inventive concepts.

FIG. 9 is a block diagram illustrating a clock generating part of a DC-DC converter according to another exemplary embodiment in accordance with the present inventive concepts.

The display apparatus according to the present exemplary embodiment is substantially the same as the display apparatus of the previous exemplary embodiment explained referring to FIGS. 1 to 8B except for a position of the second selecting part S2 being monolithically integrally incorporated inside the DC-DC IC. Thus, the same reference numerals will be used to refer to the same or like parts as those described in the previous exemplary embodiment of FIGS. 1 to 8B and any repetitive explanation concerning the above elements will be omitted.

Referring to FIGS. 1 to 3 and 9, the display apparatus includes a display panel 100 and a panel driver. The panel driver includes a timing controller 200, a gate lines driver 300, a gamma reference voltage generator 400, a data lines driver 500 and a DC-DC converter 600.

The DC-DC converter 600 includes a temperature compensating part generating an ON voltage VON to generate the clock signal CKV and the clock bar signal CKVB.

When an ambient temperature is equal to or greater than a threshold temperature, the temperature compensating part generates a first ON voltage VNO. When the ambient temperature is equal to or greater than the threshold temperature, an operating mode is a normal temperature mode. When the ambient temperature is less than the threshold temperature, the temperature compensating part generates a second ON voltage VHI which is different from the first ON voltage VNO. When the ambient temperature is less than the threshold temperature, an operating mode is a low temperature mode.

In FIG. 3, the temperature compensating part includes a first selecting part S1. The first selecting part S1 includes a first input terminal to which the first ON voltage VNO is applied, a second input terminal to which the second ON voltage VHI is applied, a selecting terminal to which a select signal SS is applied and an output terminal selectively outputting one of the first ON voltage VNO and the second ON voltage VHI according to the select signal SS.

The DC-DC converter 600 includes the clock generating part the clock signal CKV and the clock bar signal CKVB.

The clock generating part generates the first clock signal CKV1 and the first clock bar signal CKVB1 having a timing different from the first clock signal CKV1 based on the first ON voltage VNO using a first charge sharing resistor RCSN at a temperature equal to or greater than the threshold temperature. The clock generating part generates the second clock signal CKV2 and the second clock bar signal CKVB2 having a timing different from the second clock signal CKV2 based on the second ON voltage VHI using a second charge sharing resistor RCSL at a temperature less than the threshold temperature.

The clock generating part includes a first generating circuit C1 generating the first clock signal CKV1 and the second clock signal CKV2, a clock terminal TCKV outputting the first clock signal CKV1 and the second clock signal CKV2, a second generating circuit C2 generating the first clock bar signal CKVB1 and the second clock bar signal CKVB2, a clock bar terminal TCKVB connected to a first end of the second generating circuit C2 and outputting the first clock bar signal CKVB1 and the second clock bar signal CKVB2 and a second selecting part S2 connecting the first charge sharing resistor RCSN and the second charge sharing resistor RCSL to a second end of the second generating circuit C2 according to the select signal SS.

In the present exemplary embodiment, the first generating circuit C1, the second generating circuit C2 and the second selecting part S2 are monolithically integrally disposed inside a DC-DC driving chip DC-DC IC. Thus a circuit of the DC-DC converter 600 may be simplified.

According to the present exemplary embodiment, the DC-DC converter 600 may generate the second clock signal CKV2 and the second clock bar signal CKVB2 based on the second ON voltage VHI which is greater than the first ON voltage VNO at the temperature less than the threshold temperature. In addition, the DC-DC converter may generate the second clock signal CKV2 and the second clock bar signal CKVB2 using the second charge sharing resistor RCSL having a resistance greater than a resistance of the first charge sharing resistor RCSN. Thus, the decrease of the charging rate of a pixel of the display panel 100 due to deterioration of the characteristics of the switching elements of the gate lines driver 300 may be compensated. Therefore, the display quality of the display apparatus may be improved even if ambient temperature is below normal.

According to the present inventive concepts as explained above, a decrease of the pixel charging ratio at the low temperature mode is compensated for so that the display quality of the display apparatus may be improved.

The foregoing is illustrative of the present inventive concepts and is not to be construed as limiting thereof. Although a few exemplary embodiments of the present disclosure have been described, those skilled in the art will readily appreciate in light of the foregoing that many modifications are possible in the exemplary embodiments without materially departing from the novel teachings and advantages of the present disclosure of inventive concepts. Accordingly, all such modifications are intended to be included within the scope of the present teachings. In the claims, means-plus-function clauses are intended to cover the structures described herein as performing the recited function and not only structural equivalents but also functionally equivalent structures.

What is claimed is:

1. A DC-DC converter comprising:

a temperature compensating part configured to generate a first ON voltage at a temperature equal to or greater than a predetermined threshold temperature and to generate a second ON voltage at a temperature less than the threshold temperature; and a clock generating part configured to generate a first clock signal and a first clock bar signal based on the first ON voltage and while using a first charge sharing resistor at the temperature equal to or greater than the threshold temperature and to generate a second clock signal and a second clock bar signal based on the second ON voltage and while using a second charge sharing resistor at the temperature less than the threshold temperature, wherein the first clock bar signal has a different timing than that of the first clock signal, and the second clock bar signal has a different timing than that of the second clock signal, wherein a select signal is generated and is determined by a combined resistance of a variable resistor varied according to an ambient temperature, a first resistor which is connected to the variable resistor in series and a second resistor which is connected to the variable resistor in parallel, the select signal being used to pick one or the other of the first and second ON voltages, and wherein the clock generating part comprises: a first generating circuit configured to generate the first clock signal and the second clock signal; a clock terminal connected to the first generating circuit a second generating circuit configured generate to the first clock bar signal and the second clock bar signal; a clock bar terminal connected to a first end of the second generating circuit and a second selecting part configured to connect the first charge sharing resistor and the second charge sharing resistor to a second end of the second generating circuit according to the select signal.

2. The DC-DC converter of claim 1, wherein the second ON voltage is greater than the first ON voltage.

3. The DC-DC converter of claim 1, wherein a resistance of the second charge sharing resistor is greater than a resistance of the first charge sharing resistor.

4. The DC-DC converter of claim 1, wherein the variable resistor is a negative temperature coefficient ("NTC") thermistor, and a resistance of the NTC thermistor decreases when the ambient temperature increases.

5. The DC-DC converter of claim 1, wherein the temperature compensating part comprises a first selecting part configured to selectively output the first ON voltage and the second ON voltage according to the select signal, and the first selecting part comprises a first input terminal to which the first ON voltage is applied, a second input terminal to which the second ON voltage is applied, a selecting terminal to which the select signal is applied and an output terminal configured to output one of the first ON voltage and the second ON voltage.

6. The DC-DC converter of claim 1, wherein the first generating circuit and the second generating circuit are monolithically integrally disposed inside a DC-DC driving chip, and the second selecting part is disposed outside of the DC-DC driving chip.

7. The DC-DC converter of claim 1, wherein the first generating circuit, the second generating circuit and the second selecting part are disposed inside a DC-DC driving chip.

8. The DC-DC converter of claim 1, wherein the first clock signal has a level substantially the same as a level of the first clock bar signal at an end portion of a charge sharing duration at the temperature equal to or greater than the threshold temperature.

9. The DC-DC converter of claim 1, wherein the second clock signal has a level different from a level of the second clock bar signal at an end portion of a charge sharing duration at the temperature less than the threshold temperature.

10. A display apparatus comprising:

a display panel configured to display an image;

a DC-DC converter comprising:

a temperature compensating part configured to generate a first ON voltage at a temperature equal to or greater than a threshold temperature and a second ON voltage at a temperature less than the threshold temperature based on a gate clock signal according to a select signal;

a clock generating part configured to generate a first clock signal and a first clock bar signal based on the first ON voltage using a first charge sharing resistor at the temperature equal to or greater than the threshold temperature and to generate a second clock signal and a second clock bar signal based on the second ON voltage using a second charge sharing resistor at the temperature less than the threshold temperature;

a gate driver configured to generate a gate signal based on the first clock signal, the first clock bar signal, the second clock signal and the second clock bar signal and to provide the gate signal to the display panel; and a data driver configured to generate a data voltage and to provide the data voltage to the display panel, wherein the first clock bar signal having different timing from the first clock signal, and the second clock bar signal having different timing from the second clock signal, wherein the select signal is determined by a combined resistance of a variable resistor varied according to an ambient temperature, a first resistor which is connected to the variable resistor in series and a second resistor which is connected to the variable resistor in parallel, and wherein the clock generating part comprises: a first generating circuit configured to generate the first clock signal and the second clock signal; a clock terminal connected to the first generating circuit a second generating circuit configured to generate the first clock bar signal and the second clock bar signal; a clock bar terminal connected to a first end of the second generating circuit and a second selecting part configured to connect the first charge sharing resistor and the second charge sharing resistor to a second end of the second generating circuit according to the select signal.

11. The display apparatus of claim 10, wherein the second ON voltage is greater than the first ON voltage.

12. The display apparatus of claim 10, wherein a resistance of the second charge sharing resistor is greater than a resistance of the first charge sharing resistor.

13. A method of driving a display panel including a clock generating part, the clock generating part comprising: a first generating circuit a clock terminal connected to the first generating circuit a second generating circuit configured; a clock bar terminal connected to a first end of the second generating circuit and a second selecting part connecting a first charge sharing resistor and a second charge sharing resistor to a second end of the second generating circuit according to a select signal, the method comprising:

generating a first ON voltage at an ambient temperature equal to or greater than a predetermined threshold temperature and generating a second ON voltage at an ambient temperature less than the threshold temperature based on a gate clock signal according to a produced select signal;

operating the first generating circuit to generate the first clock signal and operating the second generating circuit to generate the first clock bar signal based on the first ON voltage using the first charge sharing resistor at the temperature equal to or greater than the threshold temperature;

operating the first generating circuit to generate the second clock signal and operating the second generating circuit to generate the second clock bar signal based on the second ON voltage using the second charge sharing resistor at the temperature less than the threshold temperature;

generating a gate signal based on the first clock signal, the first clock bar signal, the second clock signal and the second clock bar signal;

generating a data voltage; and displaying an image based on the gate signal and the data voltage, wherein the first clock bar signal having different timing from the first clock signal, and the second clock bar signal having different timing from the second clock signal, and wherein the select signal is determined by a combined resistance of a variable resistor varied according to an ambient temperature, a first resistor which is connected to the variable resistor in series and a second resistor which is connected to the variable resistor in parallel.

14. The method of claim 13, wherein the second ON voltage is greater than the first ON voltage.

* * * * *